United States Patent [19]

Johnson

[11] 4,320,738

[45] Mar. 23, 1982

[54] HEATING STOVE

[76] Inventor: Virgil Johnson, 3200 Fifth Ave., P.O. Box 508, Marion, Iowa 52302

[21] Appl. No.: 154,704

[22] Filed: May 30, 1980

[51] Int. Cl.[3] ..... F24C 1/14; F24B 7/00

[52] U.S. Cl. ..... 126/77; 126/69; 126/74; 126/75; 237/55

[58] Field of Search ..... 126/285 A, 292, 296, 126/297, 307 R, 307 A, 83, 69, 74, 77, 75, 286, 293; 237/55

[56] References Cited

U.S. PATENT DOCUMENTS

| | | | |
|---|---|---|---|
| 1,305,764 | 6/1919 | Alwart | 126/77 |
| 3,199,504 | 8/1965 | Morin, Jr. et al. | 126/83 |
| 4,192,285 | 3/1980 | Nietupski | 126/83 |

FOREIGN PATENT DOCUMENTS

| | | | |
|---|---|---|---|
| 360089 | 9/1922 | Fed. Rep. of Germany | 126/83 |
| 360783 | 11/1922 | Fed. Rep. of Germany | 126/83 |

*Primary Examiner*—Samuel Scott
*Assistant Examiner*—Wesley S. Ratliff, Jr.
*Attorney, Agent, or Firm*—Henderson & Sturm

[57] ABSTRACT

This stove invention relates to wood and coal burning stoves employed for heating. More effective draft control and heat transfer is achieved by a stove (11) employing straight and serpentine flues (46, 48), a control rod (43) to coordinate movement of a baffle (38) and damper (41) for defining passageways to the flues, and a channel (33) for apportioning air above and below the fuel and into first and second combustion chambers (26, 27).

1 Claim, 3 Drawing Figures

HEATING STOVE

TECHNICAL FIELD

This invention relates generally to heating devices. More particularly, the invention relates to stoves which burn wood or coal fuels and are employed for heating rooms and the like.

BACKGROUND ART

Heating stoves which use wood or coal are developed many years ago. As heating with gas, fuel oil and electricity came to be employed, such stoves fell into general disuse. Due to steadily increasing costs of gas and oil and to the need to conserve such fuels, there has been renewed interest in the use of wood and coal heating stoves.

Although a continuing problem with heating stoves has been effective transfer and use of the heat generated, today's need for energy conservation makes it more imperative that better solutions to this problem be found.

DISCLOSURE OF THE INVENTION

Responding to the needs outlined above, this invention of a heating stove includes a stove proper. A side air supply directs a draft below and above the stove grate. A control simultaneously operates a damper and a baffle to direct gases from primary and through secondary combustion chambers. Flues, one straight and one serpentine, receive gases from the combustion chambers. It is an object of this invention to provide a heating stove for wood or coal which takes in draft air and directs same to the combusion chamber in an improved manner.

Another object of this heating stove invention is to provide for better control of gas flow through the stove.

Also an object of this invention is to provide a heating stove with exhaust gas flues having a reduced tendency to foul.

A further object of this heating stove invention is the provision of apparatus for more effective transfer of heat from the stove to the space being heated.

Another object of the provision of a stove of sturdy construction which is readily operable and capable of achieving the aforementioned objects.

These objects and other features and advantages of this heating stove invention will become readily apparent upon referring to the following description in conjunction with the appended drawings.

BRIEF DESCRIPTION OF THE DRAWINGS

The heating stove invention is illustrated in the drawings wherein.

BEST MODE OF CARRYING OUT THE INVENTION

Figure 1:
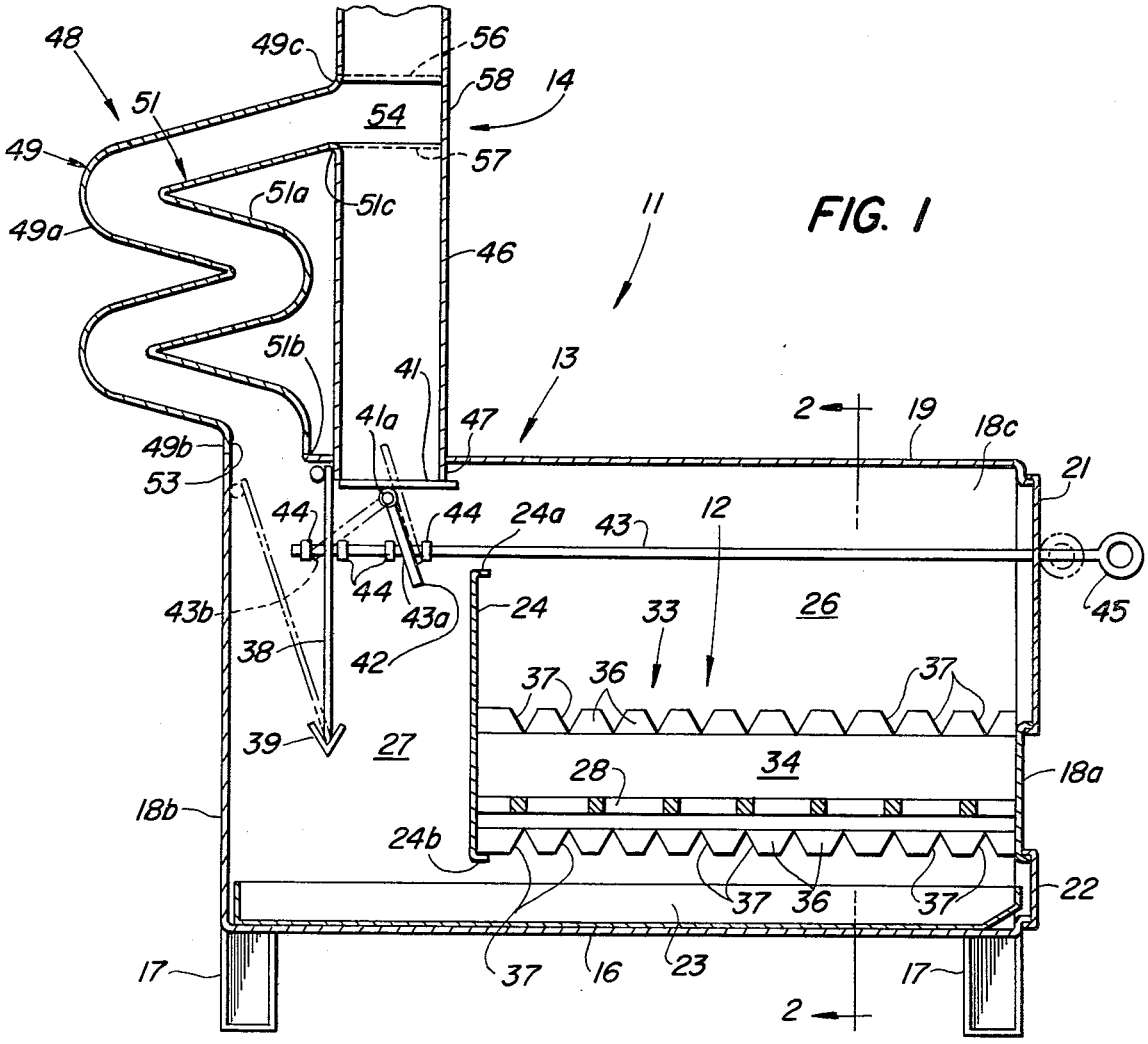
FIG. 1 is a fragmentary, longitudinal vertical sectional view of the heating stove.
Figure 3:
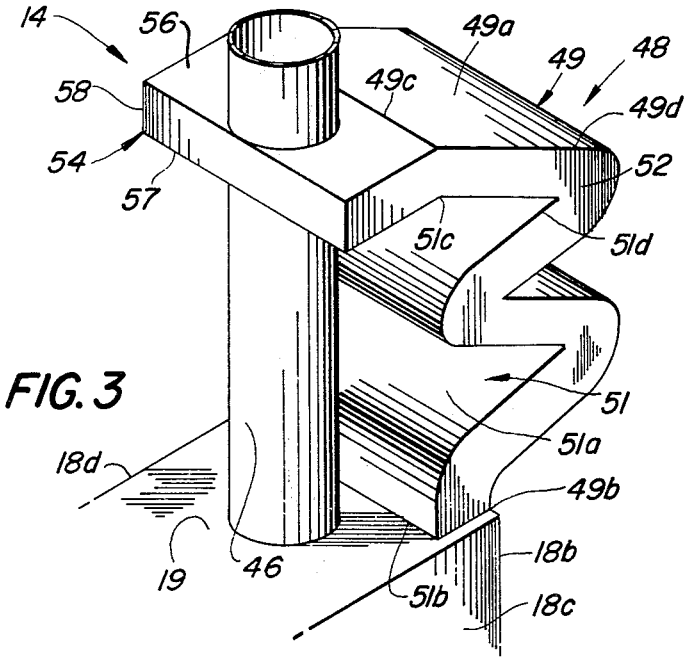
FIG. 3 is a fragmentary, respective view illustrating the exhaust gas assembly of the heating stove.
Figure 2:
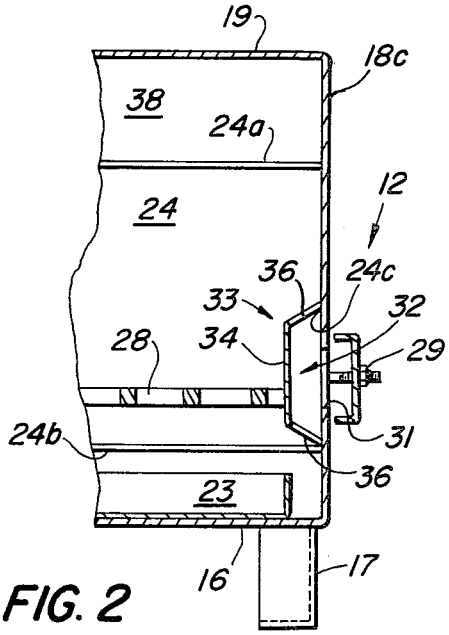
FIG. 2 is a fragmentary, sectional view of the heating stove taken along line 2—2 in FIG. 1.

The heating stove invention is shown generally at 11 in FIG. 1. The stove 11 more particularly includes an air supply assembly 12, a control assembly 13 and an exhaust gas assembly 14.

The stove 11 includes a flat plate bottom 16. A support leg 17 is attached at each of the four corners of the plate bottom 16. Front, rear, right side and left side plates 18*a*, 18*b*, 18*c*, 18*d* extend upwardly from the plate bottom 16, and a top plate 19 is attached over the upper ends of the plates 18*a*, 18*b*, 18*c*, 18*d*. A fuel-feed door 21 and an ash-pan door 22 are provided in the front plate 18*a*. The ash pan 23 is disposed on the plate bottom 16.

A fixed baffle 24 extends between the side plates 18*c*, 18*d* and is disposed approximately two-thirds of the way toward the rear plate 18 from the front plate 18*a*. The baffle 24 is parallel to the front and rear plates 18*a*, 18*b* and normal to the side plates 18*c*, 18*d*. The upper and lower horizontal edges 24*a*, 24*b* of the baffle 24 are disposed away from the plates 16, 19.

The interior of the stove 11 is divided into a combustion chamber 26 and a secondary combustion chamber 27 by the baffle 24. The chambers 26, 27 communicate above edge 24*a* and below edge 24*b*. A grate 28 further partitions the chamber 26 into a relatively larger upper space and a relatively smaller lower space. The grate 28 is fixed, extends between the front wall 18*a* and baffle 24 and between the left side plate 18*d* and the air supply assembly 12, and is disposed parallel to the plate bottom 16.

The air supply assembly 12 includes a draft air inlet door 29 attached over a draft air inlet 31 formed through the right side plate 18*c* adjacent from wall 18*a*. The inlet 31 communicates with a side air passageway 32 which extends along the inside surface of side 18*c* toward baffle 24.

A longitudinally elongated channel member 33 forms the passageway 32. The channel member 33 extends from the front wall 18*a* to the fixed baffle 24. An opening 24*c* is formed through the baffle 24, and the channel member 33 fits over the opening. The passageway 32 thereby communicates with the secondary combustion chamber 27.

The member 33 is a unitary construction having an intermediate portion 34 disposed parallel to side 18*c* and having upper and lower portions 36 extending from portion 36 to the side 18*c*. The grate 28 is fixed to the intermediate portion 34. A series of openings 37 are cut into both upper and lower portions 36, each opening being relatively broad adjacent side wall 18*c* and tapering to a point adjacent intermediate portion 34.

The control assembly 13 includes a baffle 38 disposed within the secondary combustion chamber 27. A hinge structure 39 extends from side wall 18*c* to said wall 18*d* perpendicularly thereto. The baffle 38, at its lower longitudinal edge, is attached to the hinge 39. The baffle 38 extends substantially from wall 18*c* to wall 18*d*. The baffle 38 also extends from the hinge 39 to the top plate 19 when disposed in a vertical plane. The hinge 39 is disposed one-third to one-half of the way from the bottom plate 16 to the top plate 19 and about two-thirds of the way from fixed baffle 24 to the rear wall 18*b*.

A damper 41 is attached to a rod 41*a*, which rod 41*a* extends between said walls 18*c*, 18*d* perpendicularly thereto. The rod 41*a* is mounted to be rotatable about its longitudinal axis and is disposed adjacent the top plate 19 and about one-third of the way from the baffle 24 to the rear wall 18*b*. Fixed to the rod 41*a* and generally depending therefrom is a pivot plate 42.

A control rod 43 extends through an aperture (not shown) in the front wall 18*a*, through the combustion chamber 26, over the fixed baffle 24, through a slot 43*a* cut into pivot plate 42 normal to rod 41*a*, and through a slot 43*b* cut into baffle 38 normal to the hinge structure 39. Four shoulder-forming nuts 44 are threaded onto the control rod 43, two being disposed one to each side of baffle 38 and two being disposed one to each side of pivot plate 42. The control rod 43 is oriented normal to front and rear plates 18*a*, 18*b* and parallel to bottom and top plates 16, 19. A hand-engageable ring 45 is fixed to the end of the control rod 43 exterior to the stove 11.

The exhaust assembly 14 includes a first flue 46 for smoke and gases. The flue 46 generally is cylindrical in conformation, is attached normal to the top plate 19, and has a lower portion 47 which projects below the plate 19 and opens into the secondary combustion chamber 27.

The assembly 14 also includes a second flue 48 generally serpentine in conformation. The flue 48 includes outer and inner sheets 49, 51, the surfaces 49*a*, 51*a* of which are deeply corrugated longitudinally and have lower 49*b*, 51*b* and upper 49*c*, 51*c* longitudinal edges. The sheets 49, 51 have transverse edges 49*d*, 51*d* and appear M or W-shaped in end elevation (see FIG. 1). Side plates 52 connect the plates 49, 51 at the edges 49*d*, 51*d*. The flue 48 throughout its length has a substantially rectangular cross section configuration.

A rectangular aperture 53 is formed through the top plate 19 adjacent rear plate 18*b* and spans most of the distance between said plates 18*c*, 18*d*. The flue 48 is attached to the top plate 19 over the aperture 53. The edge 49*c* of the outer sheet 49 is fixed directly over the upper edge of the rear plate 18*b*. The edge 51*c* of the inner plate 51 is fixed to the plate 19 toward the first flue 46. The sheets 49, 51 substantially span the distance between the side plates 18*c*, 18*d*.

The first and second flues 46, 48 communicate through a rectangular chamber 54. Top and bottom plates 56, 57 are connected by three side plates 58 to define the chamber 54. The first flue 46 attaches to the chamber 54 over apertures formed through plates 56, 57. The second flue 48 attaches over the open side of the chamber 54, edges 49*c*, 51*c* being fixed to the plates 56, 57 respectively.

The control assembly 13 is movable between two positions, an initial, or ignition position, shown in dotted lines in FIG. 1, and a second, or operation position, shown in solid lines in FIG. 1. In the operation position, the baffle 38 is substantially vertical and disposed against the lower portion 47 which operates as a stop. Also in the operation position, the damper 41 is pressed against the portion 47, completely covering the opening to the flue 46; and the ring 45 is disposed away from front plate 18*a*. In the ignition position, the baffle 38 is disposed at an angle to the vertical, the upper longitudinal edge thereof being pressed against the rear wall 18*b*. Also in the ignition position, the damper 41 is disposed in a position rotated toward the vertical, thereby opening portion 47 leading into the flue 46; and the ring 45 is disposed adjacent plate 18*a*.

Movement from ignition to operation positions is effected by grasping the extended ring 45 and pushing it forward front plate 18*a*. Movement of the control rod 43 will cause the shoulder nuts 44 to press against the baffle 38 and pivot plate 42. The baffle 38 pivots at 39 until it leans against the wall 18*b*. The plate 42 pivots, rotating rod 41*a*, thereby rotating the damper 41 to the open position. Movement back to the ignition position is effected by pulling on the ring 42, thereby reversing the aforementioned actions.

To use the stove 11, the draft inlet door 29 is opened and the control assembly 13 moved to the ignition position. The draft moves relatively rapidly out of the combustion chamber 26, over the baffle 24 and in a relatively direct path through portion 47 and aperture 53 into the flues 46, 48. This draft facilitates ignition of the wood or coal fuel.

Draft air entering through the inlet 31 moves through the passageway 32 and out through the series of openings 37. Primary air enters the combustion chamber 26 below the grate 28 bearing the wood or coal and moves upwardly through the grate 28. Secondary air enters the combusion chamber 26 above the grate 28, mixing with the gases from the fire to promote further combustion.

When the fuel has been ignited, the control assembly 13 is moved to the operation position. The gases from the fire travel over the baffle 24 and into the secondary combustion chamber 27. Draft air emerges from the passageway 32 through the opening 24*c* into the chamber 27, and further combustion of the gases from the fire is effected thereby.

The gases travel in a relatively indirect path, downwardly between the baffles 24, 38, around the hinge structure 39, and upwardly between the rear plate 18*b* and baffle 38, through aperture 53 into flue 48. The gases pass through the second flue 48 and into the chamber 54. As the gases travel within the flue 48 and chamber 54 for a relatively longer period of time, and as the flue 48 and chamber 54 have a relatively larger surface area, transfer of heat to the ambient air is greatly facilitated. The gases then travel upwardly out the flue 46, which has a reduced tendency to foul because of the more complete combustion and heat transfer achieved by the stove 11.

The various components of the stove 11 are fabricated from iron or steel by well known methods and are jointed together by well known techniques of welding. The industrial applicability of this invention of a stove 11 is believed apparent from the foregoing. Although a preferred mode of the invention has been described, it is to be remembered that various modifications and alternate constructions can be made without departing from the scope of the invention.

I claim:

1. A heating stove for burning wood and coal fuel, said heating stove comprising:

stove means for burning fuel;

exhaust means, for removing combustion gases from said stove means, including first and second flue means extending from said stove means, said second flue means forming a serpentine passageway;

wherein a first baffle is mounted within said stove means and defines first and second combustion chambers, a grate being disposed within said first combustion chamber, said first and second flue means being connected to said second combustion chamber; and further wherein an air supply means includes an air inlet formed into said stove means, an opening formed through said baffle, and channel means, for forming an air passageway, extending from over said air inlet, through said first combustion chamber, to said baffle over said opening, said channel means having a first series of air outlets disposed above said grate and a second series of air outlets disposed below said grate.

* * * * *